United States Patent [19]

Jeschke

[11] Patent Number: 4,621,575

[45] Date of Patent: Nov. 11, 1986

[54] PRINTING UNIT OF AN OFFSET ROTARY PRINTING MACHINE

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 719,686

[22] Filed: Apr. 4, 1985

[30] Foreign Application Priority Data

Apr. 5, 1984 [DE] Fed. Rep. of Germany ..... 3412783

[51] Int. Cl.[4] ..... B41F 7/02

[52] U.S. Cl. ..... 101/217; 101/142; 101/177; 101/178

[58] Field of Search ..... 101/116, 117, 138, 143, 101/172, 177, 178, 181, 217, 219, 223, 137, 142, 144

[56] References Cited

U.S. PATENT DOCUMENTS

| | | | |
|---|---|---|---|
| 1,052,473 | 2/1913 | Firm | 101/138 |
| 1,587,455 | 6/1926 | Wood | 101/223 |
| 1,930,986 | 10/1933 | Shaffner | 101/181 X |
| 2,118,238 | 5/1938 | Smith | 101/177 |
| 3,834,309 | 9/1974 | Zimmer | 101/116 X |
| 4,445,432 | 5/1984 | Ford, Jr. et al. | 101/177 X |

FOREIGN PATENT DOCUMENTS

| | | | |
|---|---|---|---|
| 806007 | 3/1951 | Fed. Rep. of Germany | 101/181 |

*Primary Examiner*—Edgar S. Burr
*Assistant Examiner*—John A. Weresh
*Attorney, Agent, or Firm*—Herbert L. Lerner; Laurence A. Greenberg

[57] ABSTRACT

A printing unit of an offset rotary printing machine for printing a paper web with an endless impression, the printing unit having two plate cylinders with respective printing plates disposed on half the respective peripheries thereof for providing respective partial prints successively includes at least one blanket cylinder operatively associated with the two plate cylinders, an applicating roller equal in size to that of one of the plate cylinders disposed for simultaneous engagement with both of the plate cylinders, an inking unit and a dampening unit operatively connectible via an inking cylinder with both of the plate cylinders for delivering ink and dampening fluid thereto, a sum of distances starting from a contact location at which successive partial prints provided by the two plate cylinders become united and extending via the at least one blanket cylinder, one of the plate cylinders and the inking cylinder back to the contact location corresponds to a multiple of the periphery of one of the two plate cylinders.

3 Claims, 3 Drawing Figures

PRINTING UNIT OF AN OFFSET ROTARY PRINTING MACHINE

Figure 1:
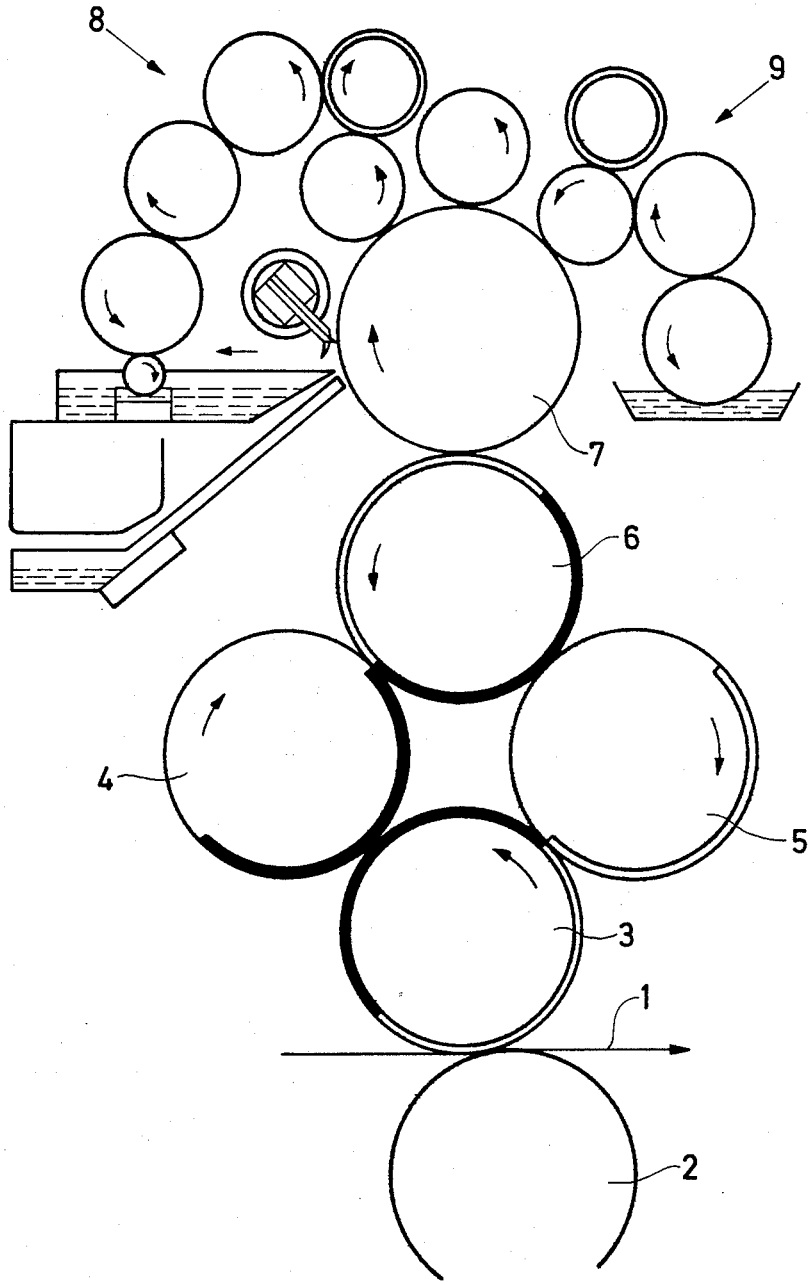

The invention relates to a printing unit of an offset rotary printing machine and, more particularly to such a machine for printing a paper web with an endless impression, the printing unit having two plate cylinders with respective printing plates disposed on half the respective periphery thereof for providing respective partial prints successively.

A conventional printing unit of this general type known from German Patent No. (DE-PS) 407 369 has already been shown in an offset printing machine for printing paper or fabric webs whereby, among other things, it is possible to have the impression or printing repeated without any gap or break on the paper web, as is necessary, for example, for printing wallpaper. For this purpose, the plate cylinders and the blanket or rubber-covered cylinders have half of the periphery thereof covered by a printing plate and a rubber blanket, respectively.

Each printing unit of the heretofore known construction has an impression cylinder with a periphery double the length of a printing plate, two rubber-covered or blanket cylinders being assigned to the impression cylinder and cooperating with a plate cylinder. Each plate cylinder, in turn, has an inking unit and a dampening unit assigned to it. The disadvantage of this heretofore known construction is that the technical outlay or expense for the printing units is very great and that it is very difficult, in addition to adjusting the ink-water balance of the two cooperating inking units, to also adjust the inking units and to maintain the adjustment during printing so that the gaplessly succeeding prints or impressions on the paper web exhibit no ink-related deviations whatsoever. The setting adjustment operations required in this connection result in production of considerable waste paper.

In contrast therewith, an object of the invention is to provide a printing unit of an offset rotary printing machine with two plate cylinders for printing a paper web with an endless impression so that, for example, a seamless wallpaper print or impression can be produced at relatively little expense.

With the foregoing and other objects in view, there is provided, in accordance with the invention, a printing unit of an offset rotary printing machine for printing a paper web with an endless impression, the printing unit having two plate cylinders with respective printing plates disposed on half the respective peripheries thereof for providing respective partial prints successively, comprising at least one blanket cylinder operatively associated with the two plate cylinders, an applicating roller equal in size to that of one of the plate cylinders disposed for simultaneous engagement with both of the plate cylinders, an inking unit and a dampening unit operatively connectible via an inking cylinder with both of the plate cylinders for delivering ink and dampening fluid thereto, a sum of distances starting from a contact location at which successive partial prints provided by the two plate cylinders become united and extending via the at least one blanket cylinder, one of the plate cylinders and the inking cylinder back to the contact location corresponding to a multiple of the periphery of one of the two plate cylinders.

In accordance with another feature of the invention, the blanket cylinder has a continuous rubber jacket thereon.

In accordance with an added feature of the invention, the two plate cylinders are offset 90° from the blanket cylinder and the inking cylinder.

In accordance with a concomitant feature of the invention, the respective blanket cylinder is assigned to each of the two plate cylinders.

A marked advantage of the invention is that the production of an endless print, for example, a wallpaper print or impression, is made possible through the use of an offset printing unit having an inking unit and a dampening unit, the construction of the printing unit being very simple and accordingly sturdy or stable and economical, yet resulting in a high quality printed of product which is achieved with a minimum of technical outlay in the machine.

Other features which are considered as characteristic for the invention are set forth in the appended claims.

Although the invention is illustrated and described herein as embodied in a printing unit of an offset rotary printing machine, it is nevertheless not intended to be limited to the details shown, since various modifications and structural changes may be made therein without departing from the spirit of the invention and within the scope and range of equivalents of the claims.

Figure 3:
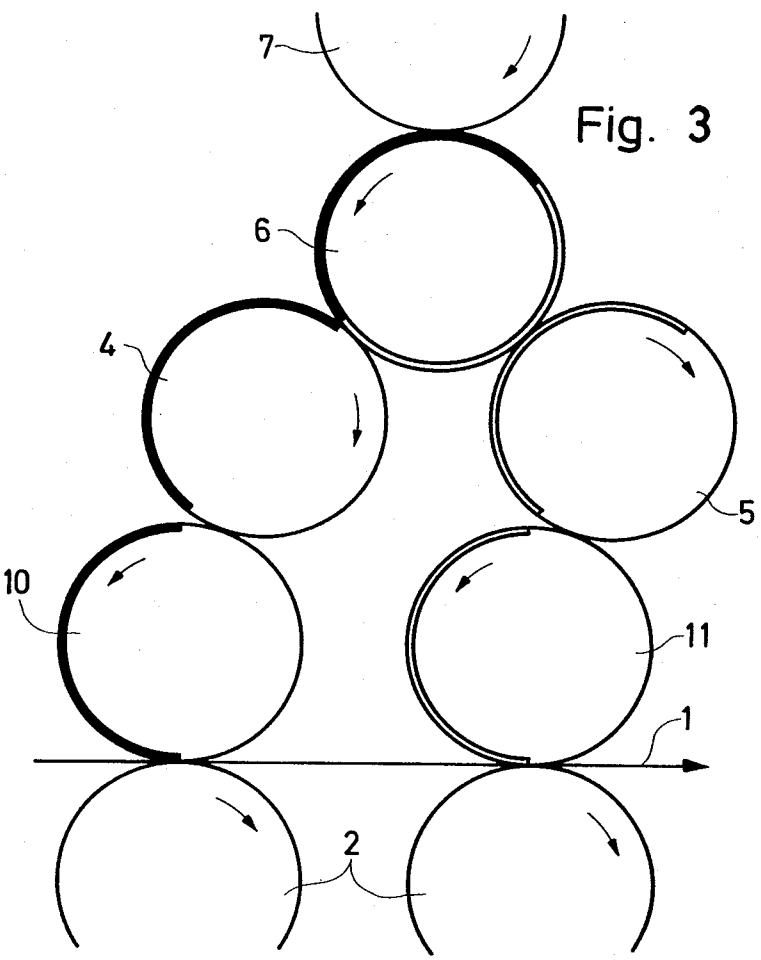
Figure 2:
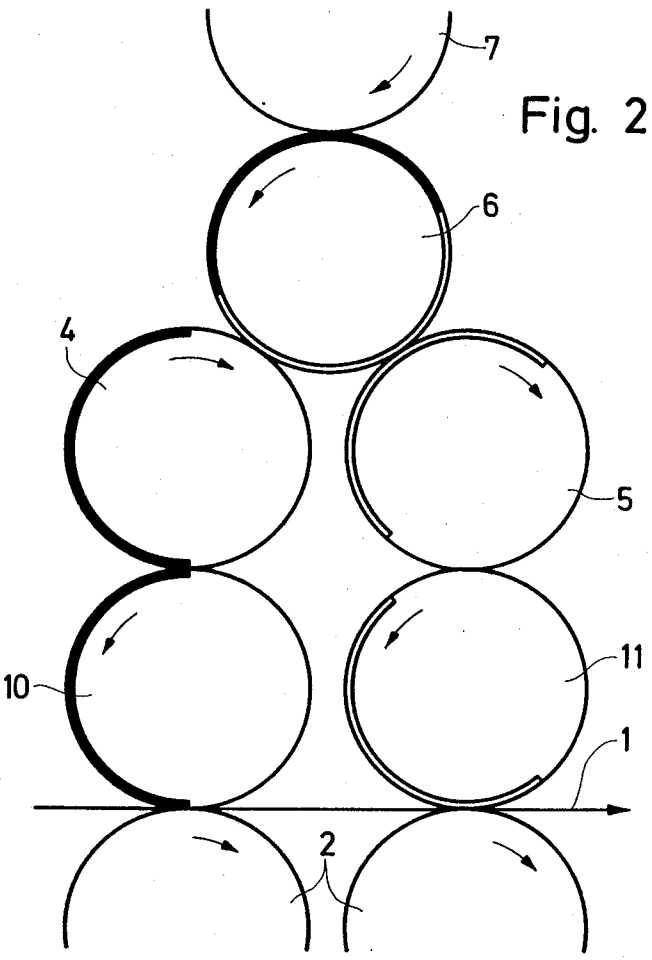

The construction and method of operation of the invention, however, together with additional objects and advantages thereof will be best understood from the following description of specific embodiments when read in connection with the accompanying drawings, in which:

FIG. 1 is a fragmentary side elevational view of a printing unit constructed in accordance with the invention; and FIGS. 2 and 3 are fragmentary views of FIG. 1 showing different arrangements of the cylinders thereof.

Referring now to the drawing and first particularly, to FIG. 1 thereof, there is shown a paper web 1 which is passed in a conventional manner between an impression cylinder 2 and a rubber-covered or blanket cylinder 3. The blanket cylinder 3 cooperates with two equal-sized plate cylinders 4 and 5, the axes of which are advantageously disposed parallel to one another and offset at an angle of 90° with respect to the axis of the blanket cylinder 3. The two plate cylinders 4 and 5 have an ink applicator roller 6 assigned thereto which is the size of either of the plate cylinders 4, 5, the axes of the two plate cylinders 4 and 5 being likewise offset by 90° with respect to the axis of the applicator roller. Assurance is thereby provided that absolutely stencil-free inking is achieved when the plate cylinders 4 and 5 have a respective printing plate occupying 180° of the periphery thereof.

The ink applicator roller 6 has a duct or inking roller 7 assigned thereto which, in turn, is engageable by an inking unit 8 and a dampening unit 9. In the embodiment of the invention shown in FIG. 1, therefore, it is possible to ink both plate cylinders 4 and 5 free of stencilling with an inking unit and a dampening unit, and thus produce the gaplessly repeated or succeeding prints or impressions on the paper web without any fluctuation or variation in the inking. Moreover, start-up paper wastage when setting or adjusting the ink-water balance is not any greater with the printing unit of the invention than with a normal or conventional offset printing unit.

In addition to the aforedescribed embodiment, it is also possible (FIGS. 2 and 3) to use two rubber-covered or blanket cylinders 10 and 11 instead of one rubber-covered cylinder and to arrange the two cylinders 10 and 11 at a given distance from one another so that the sum of the distances starting from a contact location at which successive partial prints or impressions provided by the two plate cylinders 4 and 5 become united and extending via the blanket cylinders 10 and 11, one of the plate cylinders 4 or 5 and the inking cylinder 7 back to the contact location corresponds to a multiple of the periphery of one or the two plate cylinders 4, 5, wherein the desired in-register printing offset of the half-occupied plate cylinders 4 and 5 which carry respective printing plates on only half the periphery thereof is obtained. It would thus be possible to cover half the periphery or circumference, respectively, of the rubber-covered cylinders 10 and 11 with a normal rubber blanket and to offset circumferentially the relatively narrow clamping channels for clamping the rubber blanket in order to ensure good transport or conveyance of the paper web 1. FIGS. 2 and 3 differ from one another merely in the position of the cylinders 4, 5, 10 and 11 with respect to one another.

The foregoing is a description corresponding in substance to German Application No. P 34 12 783.6, dated Apr. 5, 1984, the International priority of which is being claimed for the instant application, and which is hereby made part of this application. Any material discrepancies between the foregoing specification and the aforementioned corresponding German application are to be resolved in favor of the latter.

I claim:

1. Printing unit of an offset rotary printing machine for printing a paper web with an endless impression, the printing unit having two plate cylinders with respective printing plates disposed on half the respective peripheries thereof for providing respective partial prints successively, comprising at least one blanket cylinder operatively associated with the two plate cylinders and having an outer cylindrical surface in rolling contact therewith, an applicating roller equal in size to that of the plate cylinder and disposed for simultaneous engagement with both of the plate cylinders, an inking unit and a dampening unit operatively connectible via an inking cylinder with both of the plate cylinders for delivering ink and dampening fluid thereto, a sum of distances, as viewed in direction of the two plate cylinders, starting from a contact location between said blanket cylinder and an impression cylinder, at which successive partial prints provided by the two plate cylinders become united and extending via the outer cylindrical surface of said blanket cylinder to a contact location between said blanket cylinder and one of said plate cylinders, extending via the outer cylindrical surfaces of said one plate cylinder to a contact location between said one plate cylinder and said applicating roller, extending via the outer cylindrical surface of said applicating roller to a contact location between said applicating roller and the other of said plate cylinders, extending via the outer cylindrical surface of said other plate cylinder to a contact location between said other plate cylinder and said blanket cylinder and extending via the outer cylindrical surface of said blanket cylinder back to said contact location between said blanket and impression cylinders, being equal to a multiple of the periphery of one of the two plate cylinders.

2. Printing unit according to claim 1 wherein said blanket cylinder has a continuous rubber jacket thereon.

3. Printing unit according to claim 1 wherein said two plate cylinders are offset 90° from said blanket cylinder and said inking cylinder.

* * * * *